US005484156A

United States Patent [19]

Giguere

[11] Patent Number: 5,484,156

[45] Date of Patent: Jan. 16, 1996

[54] GOLF CLUB PRACTICE SWING WEIGHT

[76] Inventor: Michael B. Giguere, Rte. 1 Box 153 AA, Pine City, Minn. 55063

[21] Appl. No.: 194,065

[22] Filed: Feb. 9, 1994

[51] Int. Cl.[6] ..... A63B 69/36

[52] U.S. Cl. ..... 273/194 B; 273/DIG. 30; 482/105

[58] Field of Search ..... 273/194 B, 29 A, 273/26 R, 26 B, DIG. 30; 482/105, 109

[56] References Cited

U.S. PATENT DOCUMENTS 1,074,939 10/1913 Fredrikson ..... 482/105
4,052,061 10/1977 Stewart ..... 273/29 A X
4,247,101 1/1981 Gallmeyer ..... 482/105 X
4,355,801 10/1982 Thompsen ..... 482/105
4,364,560 12/1982 Gemmel ..... 273/29 A X
4,588,191 5/1986 Stewart ..... 273/194 B

*Primary Examiner*—George J. Marlo

[57] ABSTRACT

A flexible web is arranged to have secured thereto a plurality of flexible pouches, with the web including first and second ends, with a strap member having a hook and loop fastener surface extending along the strap member, with a ring member mounted between the pouches such that the strap member is arranged to loop about the ring member for securement about itself when the flexible web is mounted about a golf club shaft.

4 Claims, 3 Drawing Sheets

GOLF CLUB PRACTICE SWING WEIGHT

BACKGROUND OF THE INVENTION

1. Field of the Invention

The field of invention relates to golf club apparatus, and more particularly pertains to a new golf club practice swing weight wherein the same is arranged for securement about the shaft portion of an associated golf club.

2. Description of the Prior Art

Golf club swing weight structure is indicated in the prior art and exemplified by the U.S. Pat. Nos. 3,647,220; 4,842,280; and 4,045,034.

The instant invention attempts to overcome deficiencies of the prior art by providing for a flexible web structure arranged for ease of mounting about a golf club shaft, wherein the web structure is arranged for accommodating granular material within associated pouches and in these respects, the present invention substantially fulfills this need.

SUMMARY OF THE INVENTION

In view of the disadvantages inherent in the known types of golf club practice swing weights now present in the prior art, the present invention provides a golf club practice swing weight wherein the same is arranged for ease of mounting about a golf club shaft. As such, the general purpose of the present invention, which will be described subsequently in greater detail, is to provide a new golf club practice swing weight apparatus and method which has many of the advantages of the prior art listed heretofore and many novel features that result in a golf club practice swing weight apparatus which is not anticipated, rendered obvious, suggested, or even implied by any of the prior art, either alone or in any combination thereof.

To attain this, the present invention provides a flexible web arranged to have secured thereto a plurality of flexible pouches, with the web including first and second ends, with a strap member having a hook and loop fastener surface extending along the strap member, with a ring member mounted between the pouches such that the strap member is arranged to loop about the ring member for securement about itself when the flexible web is mounted about a golf club shaft.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended To be limiting as to the scope of the invention in any way.

It is therefore an object of the present invention to provide a new golf club practice swing weight apparatus and method which has many of the advantages of the prior art listed heretofore and many novel features that result in a apparatus which is not anticipated, rendered obvious, suggested, or even implied by any of the prior art, either alone or in any combination thereof.

It is another object of the present invention to provide a new golf club practice swing weight which may be easily and efficiently manufactured and marketed.

It is a further object of the present invention to provide a new golf club practice swing weight which is of a durable and reliable construction.

An even further object of the present invention is to provide a new golf club practice swing weight which is susceptible of a low cost of manufacture with regard to both materials and labor, and which accordingly is then susceptible of low prices of sale to the consuming public, thereby making such golf club apparatus economically available to the buying public.

Still yet another object of the present invention is to provide a new golf club practice swing weight which provides in the apparatuses and methods of the prior art some of the advantages thereof, while simultaneously overcoming some of the disadvantages normally associated therewith.

An even further object of the present invention is to provide a new golf club practice swing weight which comprises a flexible web having a plurality of flexible pouches in which weighted material may be inserted.

Still yet another object of the present invention is to provide a new golf club practice swing weight which comprises a flexible web having a plurality of flexible pouches, and a strap member such that the strap member may engage a ring member mounted between the pouches to secure the flexible member about itself and the shaft of a golf club.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
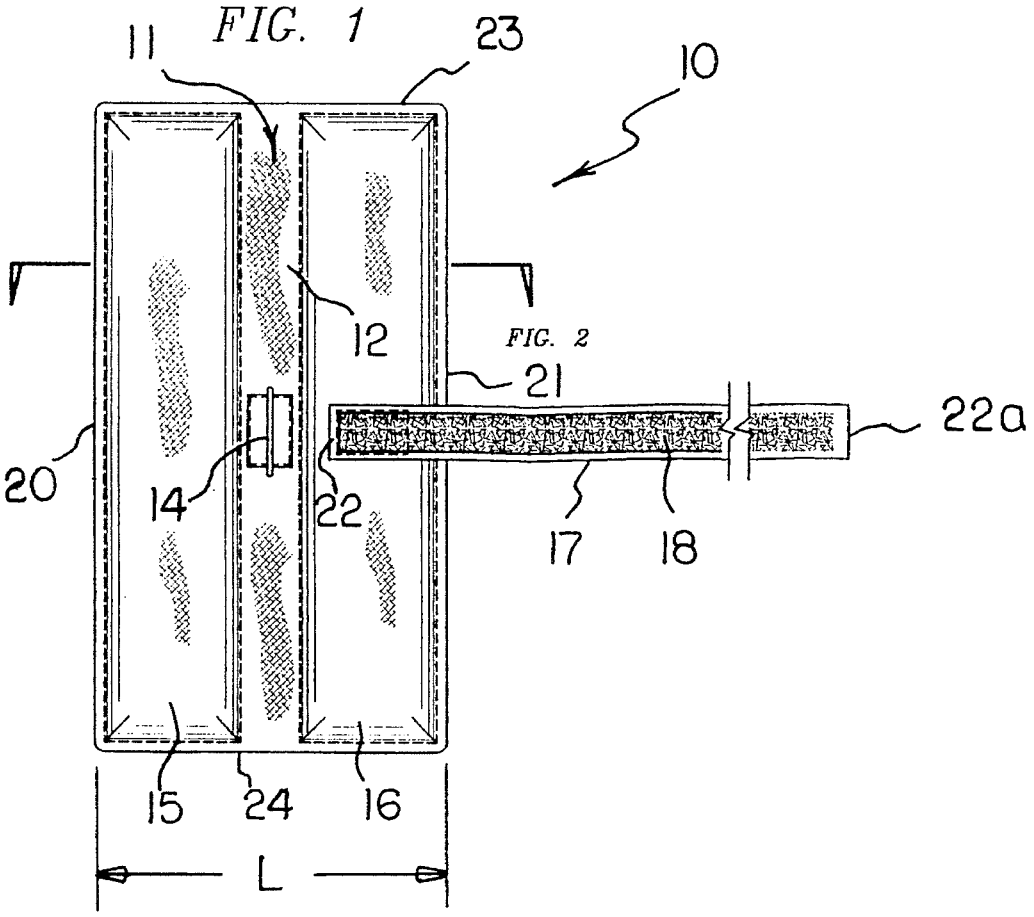
FIG. 1 is a front elevational view of the invention.

With reference now to the drawings, and in particular to FIGS. 1–6 thereof, a new golf club practice swing weight embodying the principles and concepts of the present invention and generally designated by the reference numeral 10 will be descried.

More specifically, the golf club practice swing weight 10 of the instant invention comprises a flexible web 11 having a front wall 12 spaced from a rear wall 13, and a web first end 20 spaced from a web second end 21, and a web first side 23 spaced from a web second side 24. First and second parallel, rectangular pouches 15 and 16 are mounted to the web and extend substantially between the web's first side 23 and the second side 24 in adjacency to respective first and second ends 20 and 21 thereof.

Figure 2:
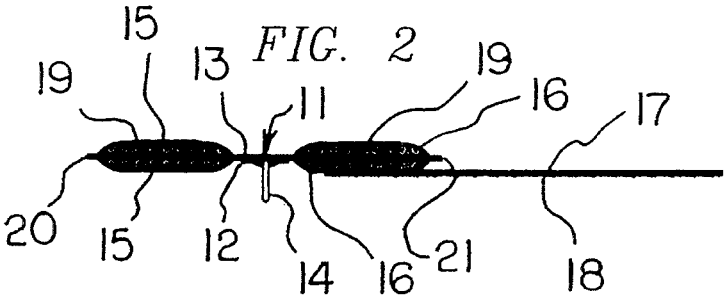
FIG. 2 is a cross sectional view, taken along the lines 2—2 of FIG. 1 in the direction indicated by the arrows.
Figure 3:
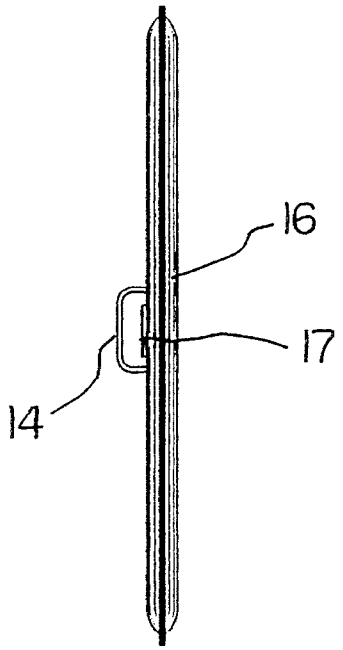
FIG. 3 is a side elevational view of the invention.

In addition and as shown in FIG. 2, a pair of the pouches 15, 16 may be secured to the web such that the first pair is positioned upon the front wall 12, with the second pair being positioned upon the rear wall 13. Regardless of the number of pouches 15, 16 utilized, the first and second pouches are filled with a granular weight material 19, such as indicated in FIG. 2.

Figure 4:
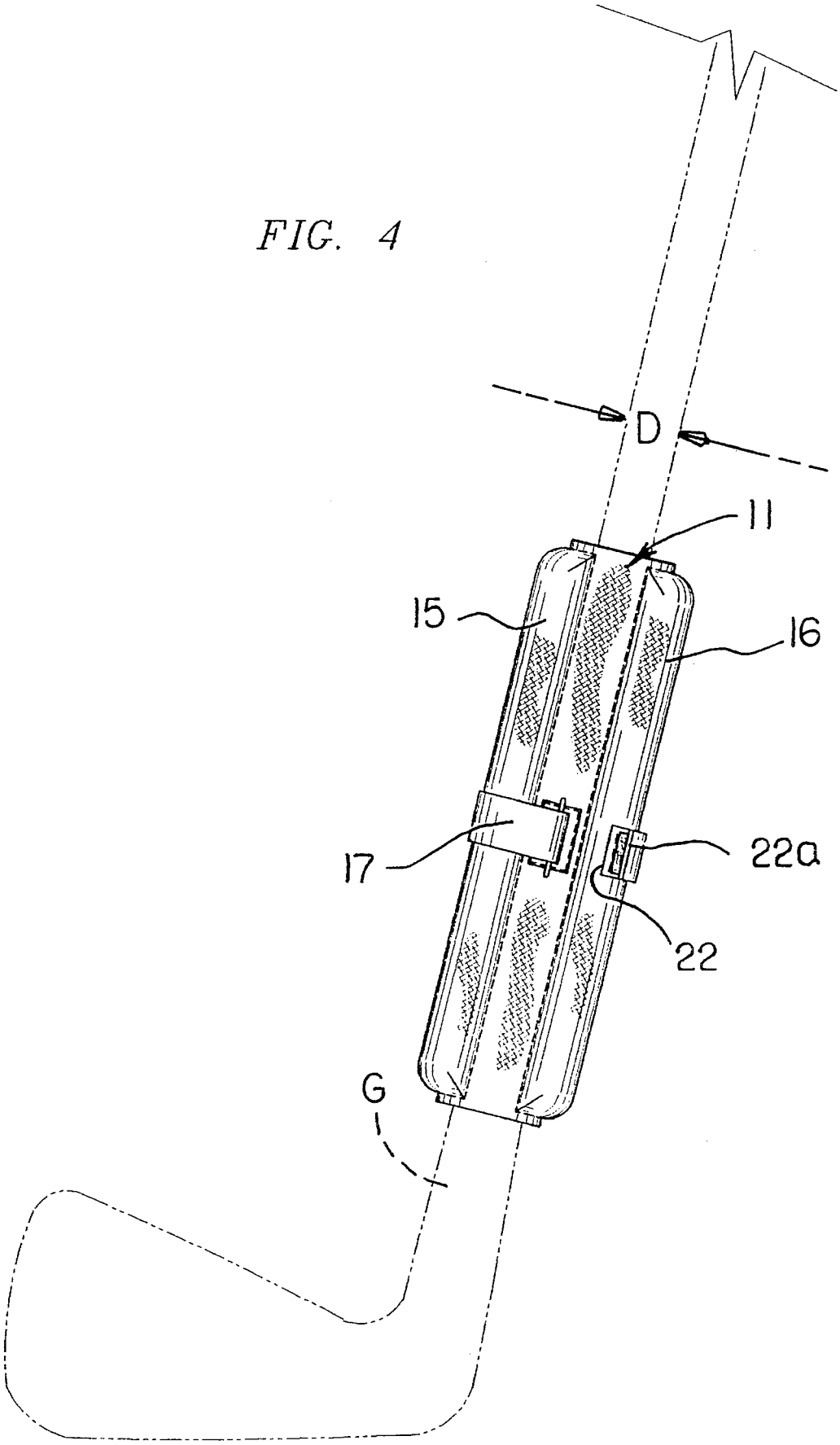
FIG. 4 is a further front elevational view of the invention arranged for mounting to a golf club shaft.

The web 11 should be no bigger than is necessary to extend approximately once around a golf club shaft "G", as illustrated in FIG. 4. Therefore, a golf club having a shaft diameter "D" will result in a maximum web length "L", as shown in FIG. 1, of approximately 3.14159 X "D". Typically, shaft diameters are approximately 10 millimeters in diameter, resulting in a typical length "L" of the web 11 being substantially equal to 31.4159 millimeters.

To permit securement to a golf club shaft "G" when the flexible web 11 is positioned around the shaft structure, as indicated in FIG. 4, a flexible strap 17 is provided. The flexible strap 17 has a strap first end 22 and a strap second end 22*a*, with the first end 22 being mounted to the second pouch 16 in adjacency to a ring member 14 that in turn is securely mounted intermediate the first and second pouches 15, 16. Extending between the strap first and second ends 22 and 22*a* is a hook and loop fastener surface 18. To secure the device 10 to the shaft "G", the strap second end 22*a* may be wrapped around the web 11, threaded through the ring 14, and folded back upon itself, whereupon the strap second end is then allowed to engage the hook and loop fastener surface 18, such as indicated in FIG. 4. In this manner, ease of securement and removal of the organization relative to the golf club shaft is provided.

Figure 5:
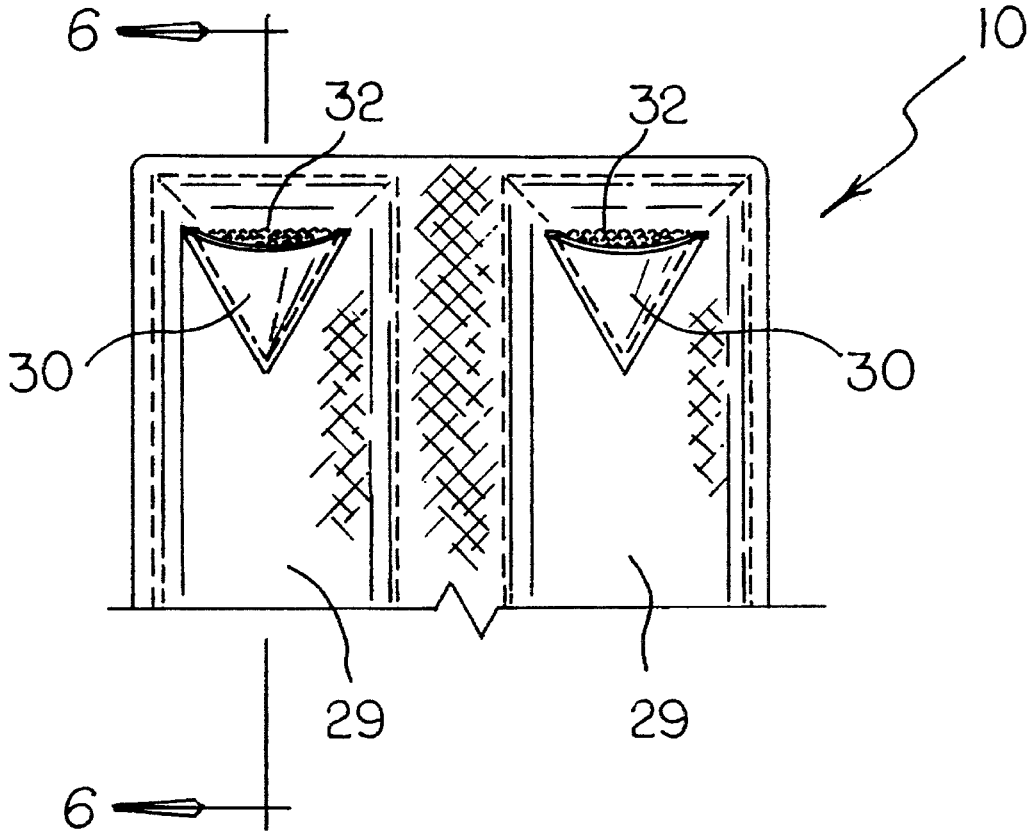
FIG. 5 is a front elevational view of a modified pouch construction for use by the invention.
Figure 6:
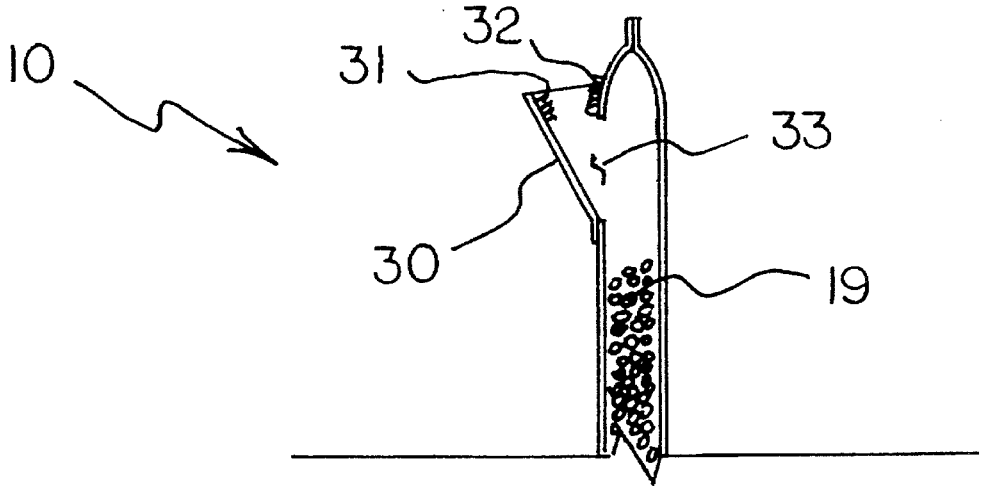
FIG. 6 is a cross sectional view taken along lines 6—6 of FIG. 5.

As best illustrated in FIGS. 5 and 6, modified pouches 29 may be employed which additionally include fill flaps 30 which are releasably secured in a sealing relationship to the pouches 29 by flap hook fasteners 31 and pouch loop fasteners 32. The fill flaps 30 permit the selective replenishment and removal of granular material 19 from within the pouch structure 29 through the pouch aperture 33, as best illustrated in FIG. 6. In addition, when the fill flaps 30 are opened as shown in FIG. 6, the flaps form a substantially V-shaped funnel which allows for the ease of placement of the granular material 19 therein. The modified pouches 29 may be utilized in addition to or in lieu of the first and second pouches 15 and 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf club practice swing weight comprising:

a flexible web having a web front wall spaced from a web rear wall, a web first end spaced from a web second end, and a web first side spaced from a web second side;

a ring member fixedly mounted medially of the front wall;

a flexible strap adapted to be looped through said ring member and having a strap first end mounted to the web adjacent the ring member, and a strap second end, with a strap hook and loop fastener surface extending between the strap first end and the strap second end so that when looped through said ring member, said strap may be fastened to itself;

at least one first pouch mounted to the front wall between the web first end and the ring member;

at least one second pouch mounted to the flexible web between the ring member and the web second end, with the first pouch and the second pouch each including a granular material contained therewithin.

2. The golf club practice swing weight as set forth in claim 1, wherein the first pouch and the second pouch each have a pouch aperture extending therethrough, and further including a fill flap secured to each pouch over said pouch aperture, with each fill flap including flap hook fasteners releasably secured in a sealing relationship to pouch loop fasteners secured to respective pouches, wherein said fill flap may be released from said pouch to permit the replenishment and removal of said granular material through each pouch aperture.

3. The golf club practice swing weight as set forth in claim 2, wherein said web is of a length equal to approximately 3.14 times a diameter of the golf club shaft to which it is to be attached.

4. The golf club practice swing weight as set forth in claim 3, wherein said web is of a length equal to approximately 31.4 millimeters.

* * * * *